US009883299B2

(12) United States Patent
Howes

(10) Patent No.: US 9,883,299 B2
(45) Date of Patent: Jan. 30, 2018

(54) SYSTEM FOR USING MULTIPLE HEARING ASSISTANCE DEVICE PROGRAMMERS

(75) Inventor: Christopher Larry Howes, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 580 days.

(21) Appl. No.: 12/967,704

(22) Filed: Dec. 14, 2010

(65) Prior Publication Data

US 2012/0087524 A1 Apr. 12, 2012

Related U.S. Application Data

(60) Provisional application No. 61/391,793, filed on Oct. 11, 2010.

(51) Int. Cl.
*H04R 25/00* (2006.01)

(52) U.S. Cl.
CPC ..... *H04R 25/70* (2013.01); *H04R 25/554* (2013.01); *H04R 2225/55* (2013.01)

(58) Field of Classification Search
CPC ..... H04R 25/70; H04R 25/30
See application file for complete search history.

(56) References Cited

U.S. PATENT DOCUMENTS 5,226,086 A * 7/1993 Platt ..... 381/58
5,564,109 A 10/1996 Snyder et al.
6,058,197 A * 5/2000 Delage ..... 381/314
6,091,764 A * 7/2000 Silk ..... H04L 29/06 370/349
7,167,726 B2 * 1/2007 Ghosh ..... G06F 1/1616 342/162
7,698,440 B2 * 4/2010 Platz et al. ..... 709/228
2002/0054689 A1 * 5/2002 Zhang et al. ..... 381/312
2006/0074572 A1 * 4/2006 Bye et al. ..... 702/57
2006/0274747 A1 12/2006 Duchscher et al.
(Continued)

FOREIGN PATENT DOCUMENTS

WO WO-2007104308 A1 9/2007

OTHER PUBLICATIONS

Microsoft Windows XP Reviewers Guide, Publisher: Microsoft Corporation Pub. Date: Aug. 2001 pp. 61.*
(Continued)

*Primary Examiner* — Duc Nguyen
*Assistant Examiner* — Taunya McCarty
(74) *Attorney, Agent, or Firm* — Schwegman Lundberg & Woessner, P.A.

(57) ABSTRACT

This disclosure relates to fitting and adjusting hearing assistance devices, including but not limited to hearing aids, using multiple programmers. A method is provided for using multiple programmers for hearing assistance devices. The method includes automatically detecting the programmers using fitting software on a personal computer. The method also includes communicating with each of the programmers simultaneously using the software to automatically detect hearing assistance devices compatible with the software. In certain variations if hearing assistance devices are detected on more than one programmer, a user is prompted to select a programmer. In certain variations, if hearing assistance devices are detected on one programmer, a fitting session is initiated for the detected hearing assistance devices.

20 Claims, 3 Drawing Sheets

(56) References Cited

U.S. PATENT DOCUMENTS

| | | | | |
|---|---|---|---|---|
| 2007/0009124 | A1* | 1/2007 | Larsen | 381/315 |
| 2007/0230711 | A1* | 10/2007 | Hasler et al. | 381/58 |
| 2008/0037798 | A1* | 2/2008 | Baechler et al. | 381/60 |
| 2009/0013003 | A1 | 1/2009 | Chang et al. | |
| 2009/0180651 | A1 | 7/2009 | Hilpisch et al. | |
| 2010/0040248 | A1 | 2/2010 | Shridhar et al. | |
| 2010/0054512 | A1* | 3/2010 | Solum | 381/315 |

OTHER PUBLICATIONS

"European Application Serial No. 11184384.3, Summons to Attend Oral Proceedings mailed Oct. 22, 2013", 7 pgs.
"European Application Serial No. 11184384.3, Examination Notification Art. 94(3) dated Mar. 8, 2013", 5 pgs.
"European Application Serial No. 11184384.3, Extended European Search Report dated Aug. 1, 2012", 8 pgs.
"European Application Serial No. 11184384.3, Response filed Feb. 13, 2013 to Extended European Search Report dated Aug. 1, 2012", 13 pgs.
"European Application Serial No. 11184384.3, Response filed Jul. 15, 2013 to Office Action dated Mar. 8, 2013", 10 pgs.

* cited by examiner

SYSTEM FOR USING MULTIPLE HEARING ASSISTANCE DEVICE PROGRAMMERS

RELATED APPLICATION

The present application claims the benefit under 35 U.S.C. 119(e) of U.S. Provisional Patent Application Ser. No. 61/391,793, filed Oct. 11, 2010, which is incorporated herein by reference in its entirety.

TECHNICAL FIELD

This disclosure relates to hearing assistance devices and more particularly to using multiple hearing assistance device programmers.

BACKGROUND

Hearing assistance devices, such as hearing aids, process sound played for a user of the device. Wearers of hearing aids undergo a process called "fitting" to adjust hearing aid settings to their particular hearing and use. In such fitting sessions the wearer may select one setting over another, much like selecting one setting over another setting in an eye test. Other types of selections include changes in level, which can be a preferred level by the wearer. After the initial fitting process, the wearer may desire further adjustments of hearing aid settings to further tune the device and/or to match different acoustic environments.

Hearing aid settings are adjusted through a programmer that is attached to a personal computer (PC) and that allows a hearing professional to make changes via a software graphical user interface. The programmer communicates from the PC to the hearing aids through either a wired or wireless communication protocol. There are several different hearing aid programmers available to program hearing aids. Some are proprietary to and work with only certain hearing aid manufacturer's products while others are compatible with a variety of manufacturers' products.

Current designs in fitting software require the professional to manually select and use only one programmer at a time to detect hearing aids. If the correct programmer is not selected, the user must take action to change to a different programmer even though the correct programmer may be connected to the PC.

There is a need in the art for an improved system for using multiple programmers for hearing assistance devices.

SUMMARY

This document provides a system for using multiple hearing assistance device programmers. In various approaches a method is provided for using multiple programmers for hearing assistance devices. The method includes automatically detecting the programmers using fitting software on a personal computer. The method also includes communicating with each of the programmers simultaneously using the software to automatically detect hearing assistance devices compatible with the software. If hearing assistance devices are detected on more than one programmer, a user is prompted to select a programmer. If hearing assistance devices are detected on one programmer, a fitting session is initiated for the detected hearing assistance devices.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter provides a method in which the host computer uses fitting software to automatically detect all available programmers and communicates with each programmer simultaneously to automatically detect hearing aids that are compatible with the fitting software, according to various embodiments. A list of connected hearing aids is presented any further input by a user, in various embodiments. This allows the user to either select from a list of hearing aids or configure the fitting software to automatically begin a fitting session.

According to various embodiments, the hearing aid fitting software provides for continuous and automatic queries to every installed, connected and compatible hearing aid programmer. The programmers continuously query for connected and compatible (wired or wireless) hearing aids and respond to the fitting software when hearing aids are detected, in various embodiments. According to various embodiments, the host computer identifies available hearing aids and presents this to the professional for action, or automatically takes action to begin the fitting session. This automatic action is configurable by the hearing professional or user, in various embodiments.

Figure 1:
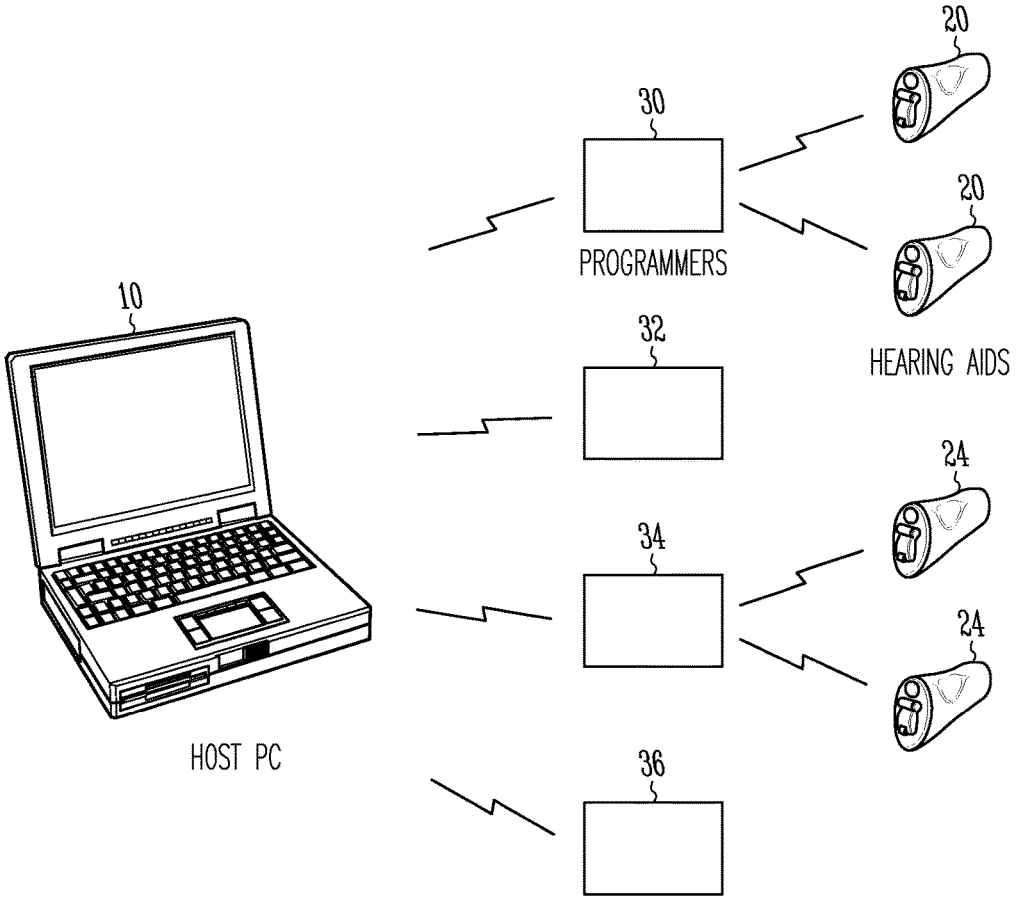
FIG. 1 is a block diagram of hearing assistance devices and programming equipment, according to various embodiments of the present subject matter.

FIG. 1 is a block diagram of hearing assistance devices and programming equipment according to one embodiment of the present subject matter. FIG. 1 shows a host computer 10 in communication with the hearing assistance devices 20 and 24. In one application, the hearing assistance devices 20 and 24 are hearing aids. Other hearing assistance devices and hearing aids are possible without departing from the scope of the present subject matter. In various embodiments, multiple programmers 30, 32, 34 and 36 are used. Programmers 30 and 34 function to facilitate communications between the host computer 10 and the hearing assistance devices 20 and 24 (e.g., hearing aids) to fit and adjust the devices 20 and 24, and may contain additional functionality and programming in various embodiments. While four programmers and hearing assistance devices are depicted, other numbers of programmers and devices can be used without departing from the scope of the present subject matter.

Host computer 10 is adapted to execute adjusting/fitting software that takes inputs from one or more input devices, (some input devices include, but are not limited to a touch screen, a keyboard, or a pointing device, such as a mouse). The software is adapted for adjusting/fitting one or more hearing assistance devices. The present subject matter displays options for adjusting parameters on a computer screen, in various embodiments. It is understood that the user may be the wearer of one or more hearing aids or can be a clinician, audiologist or other attendant assisting with the use of the adjusting/fitting system. In various embodiments, the system includes memory which stores and displays one or more user selections for the fitting system. It is understood that the configuration shown in FIG. 1 is demonstrative and is not intended in an exhaustive or exclusive sense. Other configurations may exist without departing from the scope of the present subject matter. For example, it is possible that the programming may be encoded in firmware, software, or combinations thereof.

Various methods are provided for using multiple programmers for hearing assistance devices. The methods include automatically detecting the programmers using fitting software on a personal computer. The method also includes communicating with each of the programmers at nearly the same time or simultaneously using the software to automatically detect hearing assistance devices compatible with the software. In various embodiments, fitting session is automatically initiated for the detected hearing assistance devices. In various embodiments, the system is programmed tonotify the programmers and/or the host computer if no hearing assistance devices are detected. The programmers are detected using a wireless connection, in various embodiments. In various embodiments, the programmers use a wired connection. In various embodiments, communicating with each of the programmers includes sending queries to each installed, connected and compatible programmer.

In various approaches methods are provided for using multiple programmers for hearing assistance devices. The method includes automatically detecting the programmers using fitting software executing on a computer. In various embodiments, a hostcomputer is used. Many computers or personal computing devices may be used without departing from the scope of the present subject matter. For example, in one embodiment a personal computer is used. In various embodiments, a smart phone or personal data assistant is used. In various embodiments a programmable device, such as an iPAD made by Apple Computer of Cupertino, Calif. is used. Other devices may be used without departing from the present subject matter. The method also includes communicating with each of the programmers simultaneously using the software to automatically detect hearing assistance devices compatible with the software. In various embodiments, if hearing assistance devices are detected on more than one programmer, a user is prompted to select a programmer. In various embodiments, if one or more hearing assistance devices are detected on one programmer, a fitting session is initiated for the detected hearing assistance devices. In various embodiments, the software provides a user-programmable selection to determine whether the fitting session is automatically initiated or the user is prompted to initiate the fitting session, if hearing assistance devices are detected on one programmer. In various applications, the system is programmed to conduct a fitting session with a programmer and to identify to the user of the system if another hearing aid or pair of hearing aids are connected to another programmer. In that case, the user may have several programmable options. For example, the user is notified if an aid or aids are connected to another programmer. The system can be instructed to schedule another programming session with the new aid or aids. The system can be instructed to perform another programming session with the new aid or aids. The system can be instructed to wait until a present session is complete and then perform a programming session with the new aid or aids. In various embodiments, the user can be polled after the current session is finished to determine whether to start the next programming session. The system can be programmed to offer different options or perform different operations depending on the programming that might be needed. For example, in the case of an interactive session, normally the session must be concluded before another is performed. However, in the case of a simple firmware upgrade, it is possible that simultaneous programming sessions could be conducted. Thus, the system is highly programmable and can be adapted for various different programming tasks.

In various embodiments, the host computer resides at the same location as the programmers. In various embodiments, the programmers are at a different location or locations than the host computer. In various embodiments, the programmer is at the same location as at least one programmer and at least one other programmer is at a different location. In various embodiments, a connection is established which at least in part uses a computer network. In various embodiments, the computer network includes the INTERNET. Other variations exist without departing from the present subject matter.

Figure 2:
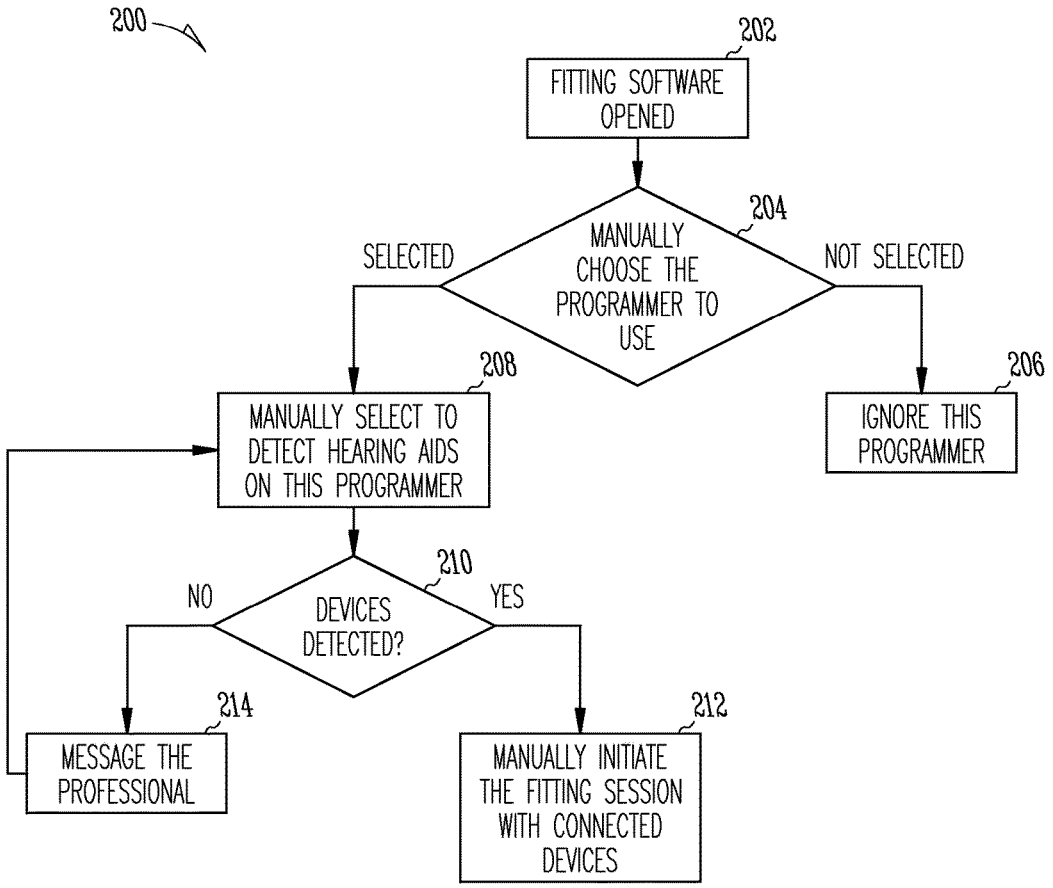
Fig.2 (Prior Art)
FIG. 2 is a flow diagram of a method for choosing a hearing assistance device programmer.

FIG. 2 is a flow diagram of a currently used method for choosing a hearing assistance device programmer. The method 200 includes opening fitting software on a host computer, at 202. A user manually selects which programmer to use at 204. If a programmer is not selected, it is not used by the system at 206. After selecting a programmer, a user manually initiates detection of hearing aids for the selected programmer, at 208. If no hearing aids are detected at 210, a message is sent to the user at 214 and the method returns to selection step 208. If hearing aids are detected at 210, a user manually initiates a fitting session for the selected hearing aids, at 212.

Figure 3:
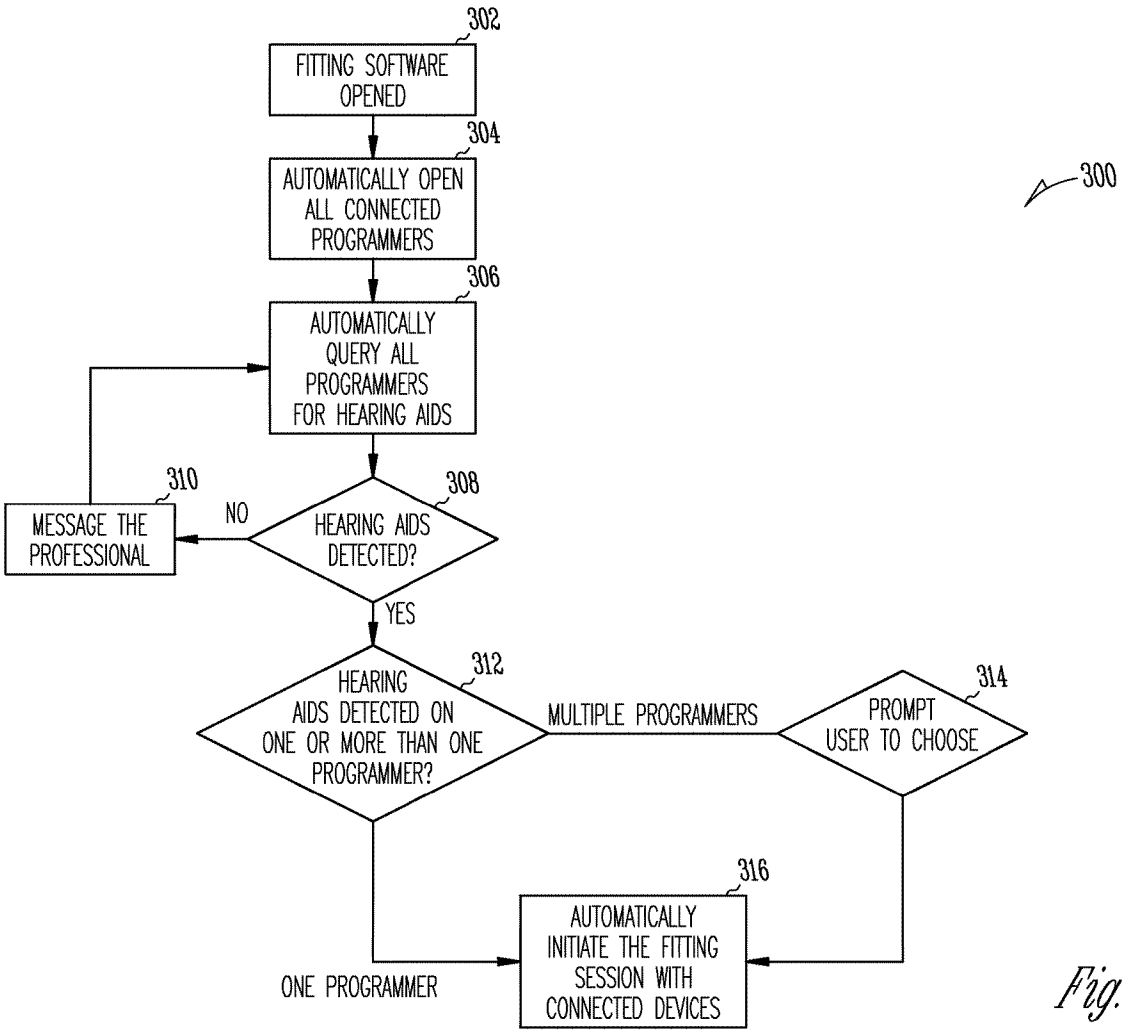
FIG. 3 is a flow diagram of a method for using multiple hearing assistance device programmers, according to various embodiments of the present subject matter.

FIG. 3 is a flow diagram of a method for using multiple hearing assistance device programmers, according to various embodiments of the present subject matter. The method 300 includes opening fitting software or executing the fitting software, at 302. The connected programmers are automatically opened or located at 304. At 306, the programmers automatically query for hearing aids. If no hearing aids are detected at 308, a message is sent to the user at 310 and the method returns to step 306. If hearing aids are detected at 308, then if hearing aids are detected on a single programmer at 312, a fitting session is automatically initiated with connected devices at 316. If hearing aids are detected on multiple programmers at 312, a user is prompted to select a programmer at 314 before the fitting session is automatically initiated at 316. In variations of this method, other approaches may be taken without departing from the scope of the present subject matter and as set forth herein. For example, the system may allow the user of the fitting system to choose a programmer to work with (and its associated hearing aid or aids to program), and then may allow the user to select other programmers. The system may also determine that simultaneous programming may be performed, for example, in cases of firmware upgrades which do not require much user interactions. In various applications, the prompts may eliminate hearing aids and programmers that were already programmed to allow the user to focus on devices remaining to be fitted/programmed. In various applications, a current programming session is conducted and another programming session is scheduled to occur after the current session completes. Other variations exist which take advantage of the programmability of the present system and do not depart from the claimed subject matter.

This disclosure provides a method including detecting available programmers that are supported in the fitting software and communicating with each programmer simultaneously to detect all associated hearing devices regardless of the programmer, according to various embodiments. This simultaneous use of different programmers provides the benefit of not needing to manually transition between programmers when working with different types of products or new vs. older technology. Technology is changing rapidly and the present subject matter provides for the use of new programmers while retaining support for older products. This provides seamless support for varying types of programmers and eases the burden on the user or hearing professional. It is understood that in various applications hearing aid(s) may be connected to their respective programmer via a wired or wireless connection.

In various embodiments, a network connection is used to transmit or receive information for fitting or adjusting the hearing assistance device. In various embodiments, the INTERNET is used to communicate information for the fitting. In various embodiments a wireless connection is used to communicate information for the fitting. In various embodiments, a wired connection is used to communicate information for the fitting.

The present subject matter includes hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for communicating with programmers of hearing assistance devices, the method comprising:

executing fitting software on a computer;

automatically detecting the programmers using the fitting software and the computer;

automatically detecting hearing assistance devices connected to the programmers;

if hearing assistance devices are detected on more than one programmer, prompting a user to select a programmer compatible with the fitting software from the more than one programmer;

if hearing assistance devices are detected on one programmer and if the computer is previously configured for automatic action by a user, using the computer to automatically initiate fitting sessions for each of the detected hearing assistance devices using the one programmer connected to and compatible with the detected hearing assistance devices; and using a wireless data transmission to notify the fitting software of any programmers having no hearing assistance devices detected.

2. The method of claim 1, further comprising communicating with each of the programmers simultaneously to detect hearing assistance devices.

3. The method of claim 1, wherein automatically detecting the programmers includes detecting the programmers wirelessly.

4. The method of claim 1, wherein communicating with each of the programmers includes sending queries to each installed, connected and compatible programmer.

5. The method of claim 1, wherein the hearing assistance devices include a cochlear implant.

6. The method of claim 1, wherein the hearing assistance devices include a hearing aid.

7. The method of claim 6, wherein the hearing aid includes a behind-the-ear (BTE) hearing aid.

8. The method of claim 6, wherein the hearing aid includes an in-the-ear (ITE) hearing aid.

9. The method of claim 6, wherein the hearing aid includes a receiver-in-the-canal hearing aid.

10. The method of claim 9, wherein the hearing aid includes a completely-in-the-canal (CIC) hearing aid.

11. A method for using multiple programmers for fitting hearing assistance devices, the method comprising:

automatically detecting the programmers using fitting software on a computer;

communicating with each of the programmers using the software to automatically detect hearing assistance devices compatible with the fitting software;

if hearing assistance devices are detected on more than one programmer, prompting a user to select a programmer compatible with the fitting software from the more than one programmer;

if the computer is previously configured for automatic action by the user, automatically initiating a fitting session for each of the hearing assistance devices detected on the selected programmer using the computer and the programmer upon selection of the programmer; and using a wireless data transmission to notify the fitting software of any programmers having no hearing assistance devices detected.

12. The method of claim 11, further comprising:

communicating with each of the programmers simultaneously to detect hearing assistance devices.

13. The method of claim 11, wherein automatically detecting the programmers includes detecting the programmers wirelessly.

14. The method of claim 11, wherein communicating with each of the programmers includes sending queries to each detected programmer.

15. The method of claim 11, wherein the hearing assistance devices include a cochlear implant.

16. The method of claim 11, wherein the hearing assistance devices include a hearing aid.

17. The method of claim 16, wherein the hearing aid includes a behind-the-ear (BTE) hearing aid.

18. The method of claim 16, wherein the hearing aid includes an in-the-ear (ITE) hearing aid.

19. The method of claim 16, wherein the hearing aid includes a receiver-in-the-canal hearing aid.

20. The method of claim 16, wherein the hearing aid includes a completely-in-the-canal (CIC) hearing aid.

* * * * *